US009263857B2

(12) United States Patent
Nakayama et al.

(10) Patent No.: US 9,263,857 B2
(45) Date of Patent: Feb. 16, 2016

(54) IGNITION SYSTEM

(71) Applicant: NGK Spark Plug Co., LTD., Aichi (JP)

(72) Inventors: Katsutoshi Nakayama, Aichi-ken (JP); Kohei Katsuraya, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 432 days.

(21) Appl. No.: 13/782,134

(22) Filed: Mar. 1, 2013

(65) Prior Publication Data

US 2013/0234608 A1 Sep. 12, 2013

(30) Foreign Application Priority Data

Mar. 7, 2012 (JP) ..... 2012-050091

(51) Int. Cl.
*F02P 3/05* (2006.01)
*H01T 13/40* (2006.01)
*F02P 1/00* (2006.01)

(52) U.S. Cl.
CPC .. *H01T 13/40* (2013.01); *F02P 1/00* (2013.01)

(58) Field of Classification Search
CPC ..... F02P 23/04; F02P 9/007; F02P 3/01
USPC ..... 123/620, 606, 618–619, 143 B; 315/174
See application file for complete search history.

(56) References Cited

U.S. PATENT DOCUMENTS 2,251,451 A * 8/1941 Heinrich ..... B03C 3/66 95/80
3,934,566 A 1/1976 Ward ..... 123/119
3,974,412 A * 8/1976 Pratt, Jr. ..... F02P 9/007 123/169 EL
4,138,980 A 2/1979 Ward ..... 123/119
5,992,354 A * 11/1999 Ahern ..... C10L 1/328 123/1 A
6,054,813 A * 4/2000 Takeda ..... H05B 41/2821 315/209 R
6,653,767 B2 * 11/2003 Morita et al. ..... 313/141

FOREIGN PATENT DOCUMENTS

JP 51-77719 7/1976 ..... F02H 27/00
JP 2010-101208 5/2010 ..... F02P 13/00
JP 2010-144618 7/2010 ..... F02P 3/01
JP 2010144618 A * 7/2010
JP 2010-249033 11/2010 ..... F02P 3/01

OTHER PUBLICATIONS

Notification of Reasons for Rejection issued in connection with Japanese Patent Application No. 2012-050091, dated Feb. 4, 2014 (including English language translation).

* cited by examiner

*Primary Examiner* — Erick Solis
*Assistant Examiner* — Josh Campbell
(74) *Attorney, Agent, or Firm* — Kusner & Jaffe

(57) ABSTRACT

A superior ignitability is realized assuredly by specifying at least either of a relation in magnitude between absolute values of a plus-side voltage and a minus-side voltage and a relation in magnitude between absolute values of a plus-side current and a minus-side current when alternating current power is introduced. An ignition system includes a spark plug, a discharging power supply which applies a voltage to a spark gap of the spark plug to thereby generate an electric spark discharge and an alternating current power supply which introduces alternating current power to an electric spark generated by the electric spark discharge to generate an alternating current plasma.

10 Claims, 9 Drawing Sheets

IGNITION SYSTEM

CROSS-REFERENCE TO RELATED APPLICATION

This application is based on and claims priority under 35 USC 119 to Japanese Patent Application No. 2012-050091 filed on Mar. 7, 2012, the entire contents of which are incorporated herein by reference.

FIELD OF THE INVENTION

The present invention relates to an ignition system having a spark plug.

BACKGROUND OF THE INVENTION

A spark plug used in a combustion chamber of an internal combustion chamber includes, for example, a center electrode which extends in an axial direction, an insulator which is provided to surround an outer circumference of the center electrode, a cylindrical metal shell which is assembled to an outside of the insulator and a ground electrode which is joined to a front end portion of the metal shell at a proximal end portion thereof. Then, by applying a high voltage to the center electrode, an electric spark is generated in a spark gap defined between the center electrode and the ground electrode, as a result of which a compressed air-fuel mixture is ignited.

In addition, there is proposed a technique in the patent literature in which a compressed air-fuel mixture is ignited by introducing alternating current power into a spark gap.

However, the technique described in the patent literature specifies nothing about the alternating current power that is introduced into the spark gap, leading to fears that the ignitability cannot be increased.

SUMMARY OF THE INVENTION

The invention has been made in view of these situations and an object thereof is to provide an ignition system which can assuredly realize a superior ignitability by specifying at least either of a relation in magnitude between absolute values of a plus-side voltage and a minus-side voltage and a relation in magnitude between absolute values of a plus-side current and a minus-side current when alternating current power is introduced.

Configurations suitable for attaining the object will be itemized below. It should be noted that working effects specific to the corresponding configurations will also be added as required.

(1) An ignition system including:

a spark plug having a center electrode and a ground electrode;

a discharging power supply which applies a voltage to a spark gap defined between the center electrode and the ground electrode to generate an electric spark discharge in the spark gap; and an alternating current power supply which introduces alternating current power to an electric spark generated by the electric spark discharge so as to generate an alternating current plasma in the spark gap, wherein a lower one of an absolute value of an average of peak values of a plus-side voltage applied to the spark gap and an absolute value of an average of peak values of a minus-side voltage applied to the spark gap in an introduction duration of the alternating current power is 20% or more of a higher one of both the absolute values.

It should be noted that the "plus side" means that the electric potential of the center electrode is higher than the electric potential of the ground electrode and that the "minus side" means that the electric potential of the center electrode is lower than the electric potential of the ground electrode.

According to the configuration described under (1) above, since the voltages having the different polarities are applied to the spark gap, the collision of atoms can be generated in the spark gap with great frequency. Because of this, it is possible to increase plasmas (ions and electrons) generated in association with the collision of atoms.

Further, according to the same configuration, the lower value of the absolute value of the average of peak values of the plus-side voltage and the absolute value of the average of peak values of the minus-side voltage is 20% or more of the higher value of both the voltages. Namely, a difference between the absolute values of the voltages of both the polarities which are applied to the spark gap is designed to be sufficiently small. Consequently, it is possible to generate the plasma having high density in the central portion of the spark gap around which there are few things to suppress the propagation of the plasma and which is spaced apart both from the center electrode and the ground electrode to thereby be less affected by a flame extinguishing action (an action in which the heat of the plasma is absorbed by the electrodes, whereby the growth of plasma is interrupted) by the electrodes. As a result, it is possible to allow the plasma to grow to be very large, enabling the realization of superior ignitability assuredly.

(2) The ignition system according to (1), wherein a lower one of the absolute value of the average of peak values of a plus-side voltage applied to the spark gap and the absolute value of the average of peak values of a minus-side voltage applied to the spark gap in the introduction duration of the alternating current power is 70% or more of a higher one of both the absolute values.

According to the configuration described under (2) above, a difference between the absolute values of the voltages of both the polarities which are applied to the spark gap is designed to be very small. Consequently, it is possible to generate the collision of atoms in the spark gap with greater frequency to thereby allow the plasma having high density to be generated in a more central portion of the spark gap. As a result, it is possible to allow the plasma to grow to be larger, thereby making it possible to increase the ignitability further.

(3) The ignition system according to (1) or (2), wherein a voltage of alternating current power which is introduced from the alternating current power supply is larger than an absolute value of an average voltage of an induction current which is fed to the spark gap by a voltage applied from the discharging power supply.

It should be noted that the "output voltage of the alternating current power supply" means the capacity of the alternating current power supply and denotes the value of an average of absolute values of peak values of the plus-side and minus-side voltages.

According the configuration described under (3) above, it is possible to apply both the plus-side voltage and the minus-side voltage to the spark gap assuredly while the induction current is being fed. As a result, the working effects provided by the configuration (1) can be exhibited assuredly.

(4) An ignition system including:

a spark plug having a center electrode and a ground electrode;

a discharging power supply which applies a voltage to a spark gap defined between the center electrode and the ground electrode to generate an electric spark discharge in the spark gap; and an alternating current power supply which introduces alternating current power to an electric spark generated by the electric spark discharge so as to generate an alternating current plasma in the spark gap, wherein a lower one of an absolute value of an average of peak values of a plus-side current fed to the spark gap and an absolute value of an average of peak values of a minus-side current fed to the spark gap in an introduction duration of the alternating current power is 20% or more of a higher one of both the absolute values.

It should be noted that the "plus side current" means an electric current which is fed from the center electrode to the ground electrode and that the "minus side current" means an electric current which is fed from the ground electrode to the center electrode.

According to the configuration described under (4) above, since the currents having the different polarities are fed to the spark gap, the collision of atoms can be generated in the spark gap with great frequency. Consequently, it is possible to increase plasmas (ions and electrons) generated in association with the collision of atoms.

Further, according to the same configuration, A difference between the absolute values of the currents of both the polarities which are fed to the spark gap is designed to be small sufficiently. Consequently, it is possible to generate the plasma having high density in the central portion of the spark gap. As a result, it is possible to allow the plasma to grow to be very large, enabling the realization of superior ignitability assuredly.

(5) The ignition system according to (4), wherein a lower one of the absolute value of the average of peak values of a plus-side current fed to the spark gap and the absolute value of the average of peak values of a minus-side current fed to the spark gap in the introduction duration of the alternating current power is 70% or more of a higher one of both the absolute values.

According to the configuration described under (5) above, it is possible to generate the collision of atoms in the spark gap with greater frequency to thereby allow the plasma having high density to be generated in a more central portion of the spark gap. As a result, it is possible to allow the plasma to grow to be larger, thereby making it possible to increase the ignitability further.

(6) The ignition system according to (4) or (5), wherein a higher of an absolute value of an average of peak values of a plus-side current fed to the spark gap and an absolute value of an average of peak values of a minus-side current fed to the spark gap in the introduction duration of the alternating current power is 1 A or more.

According to the configuration described under (6) above, it is possible to increase the plasma generated in the spark gap further. As a result, it is possible to allow the plasma to grow to be larger, thereby making it possible to improve the ignitability further.

(7) The ignition system according to any of (1) to (6), wherein an oscillation frequency of the alternating current power is 10 kHz or more.

According to the configuration described under (7) above, it is possible to increase the number of times of collision of atoms in the spark gap further, thereby making it possible to increase the generation of plasma further. This can realize a further improvement of ignitability.

(8) The ignition system according to any of (1) to (7), wherein the size of the spark gap is 0.3 mm or more and 1.3 mm or less.

In a general ignition system in which ignition is executed by an electric spark discharge, as the size of a spark gap decreases, a center electrode and a ground electrode approach a position where a flame core is generated. Consequently, when the size of the spark gap is small, the influence of a so-called flame extinguishing action (an action in which the heat of a flame core is taken away by the center electrode and the ground electrode) is increased, whereby the ignitability is reduced. However, in order to reduce the influence of the flame extinguishing action, it is considered to increase the size of the spark gap. However, when the spark gap is increased excessively, the voltage required for electric spark discharge (the discharge voltage) is increased. As a result of this, the erosion of the center electrode and the ground electrode is promoted, and an electric spark discharge tends to occur easily in other locations than the spark gap (namely, in improper positions).

In contrast with this, in the ignition system according to the configuration described under (1) above, since the plasma grows largely towards the outside of the spark gap, even in the event that the size of the spark gap is very small (for example, 0.3 mm or more and 0.5 mm or less), it is possible to realize a sufficiently superior ignitability. In addition, since the size of the spark gap can be reduced, it is possible to realize a reduction in discharge voltage. As a result of this, the erosion of the center electrode and the ground electrode can be suppressed effectively, and the electric spark discharge can be generated in the spark gap (namely, in the proper position) more assuredly. Namely, with the ignition system according to (1) above, in the case of the size of the spark gap being very small (in the case of the spark gap being 0.3 mm or more and 0.5 mm or less), it is possible to realize the superior ignitability while realizing the suppression of erosion of the center electrode and the like and the generation of electric spark discharge in the proper position more assuredly.

It should be noted that in the case of the size of the spark gap being less than 0.3 mm, the generation of plasma is reduced, leading to fears that the ignitability cannot be improved sufficiently. In addition, in the case of the size of the spark gap being more than 1.3 mm, an excessive discharge voltage is called for, leading to fears that the erosion of the center electrode and the ground electrode is promoted and the electric spark discharge tends to be generated readily in the improper positions. Consequently, in consideration of these points, it is preferable that the size of the spark gap is set to be 0.3 mm or more and 1.3 mm or less.

DETAILED DESCRIPTION OF THE INVENTION

Figure 1:
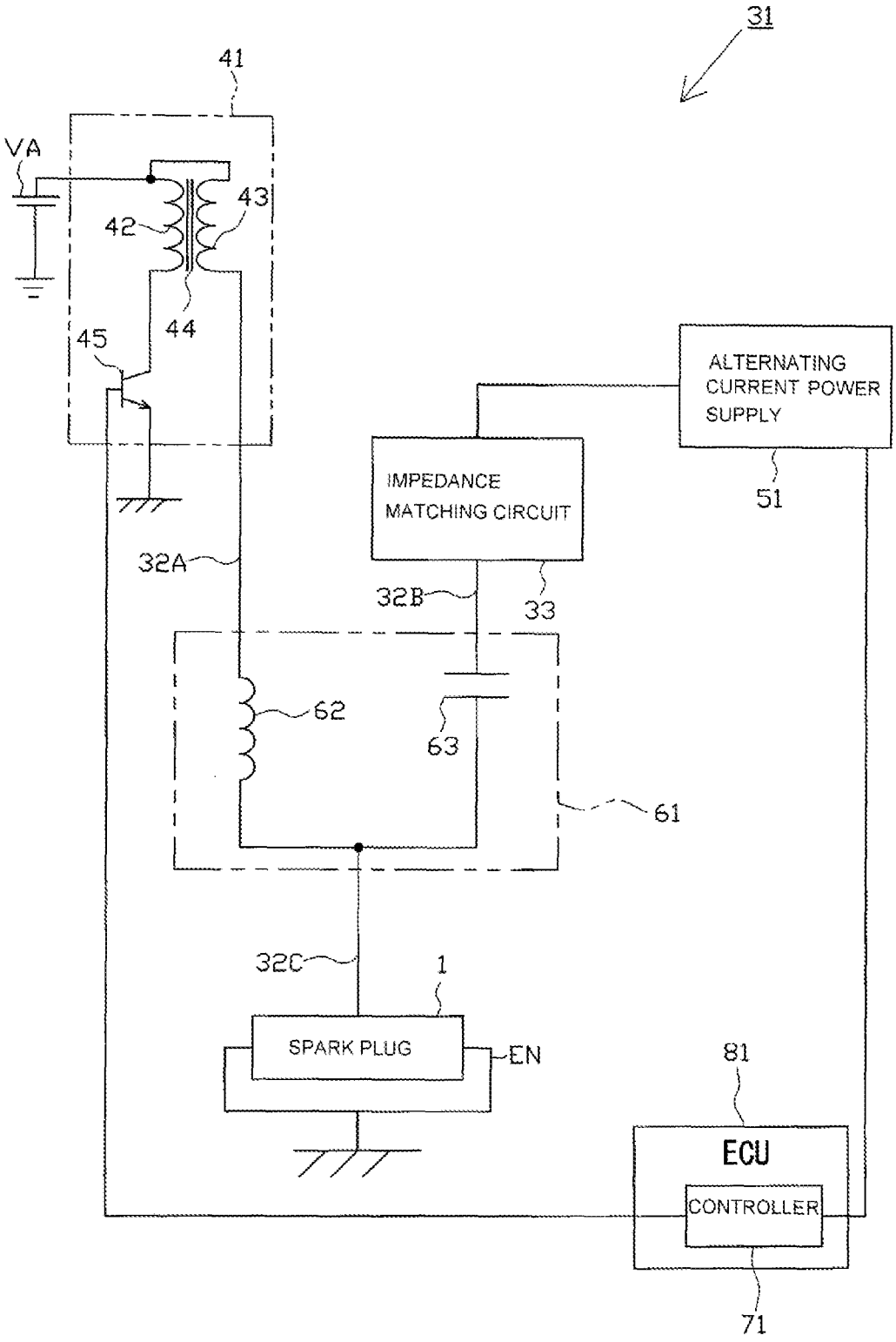
FIG. 1 is a block diagram depicting a schematic configuration of an ignition system.

Hereinafter, an embodiment of the invention will be described by reference to the drawings. FIG. 1 is a block diagram depicting a schematic configuration of an ignition system 31. As depicted in FIG. 1, the ignition system 31 includes a spark plug 1 mounted in an internal combustion engine EN, a discharging power supply 41, an alternating current power supply 51, a mixer circuit 61 and a controller 71. It should be noted that although only a single spark plug 1 is shown in FIG. 1, in reality a plurality of cylinders are provided in the internal combustion engine EN and spark plugs 1 are provided so as to correspond individually to the cylinders. Then, electric power is supplied to the individual spark plugs 1 via a distributor, not shown, from the discharging power supply 41 or the alternating current power supply 51.

Figure 2:
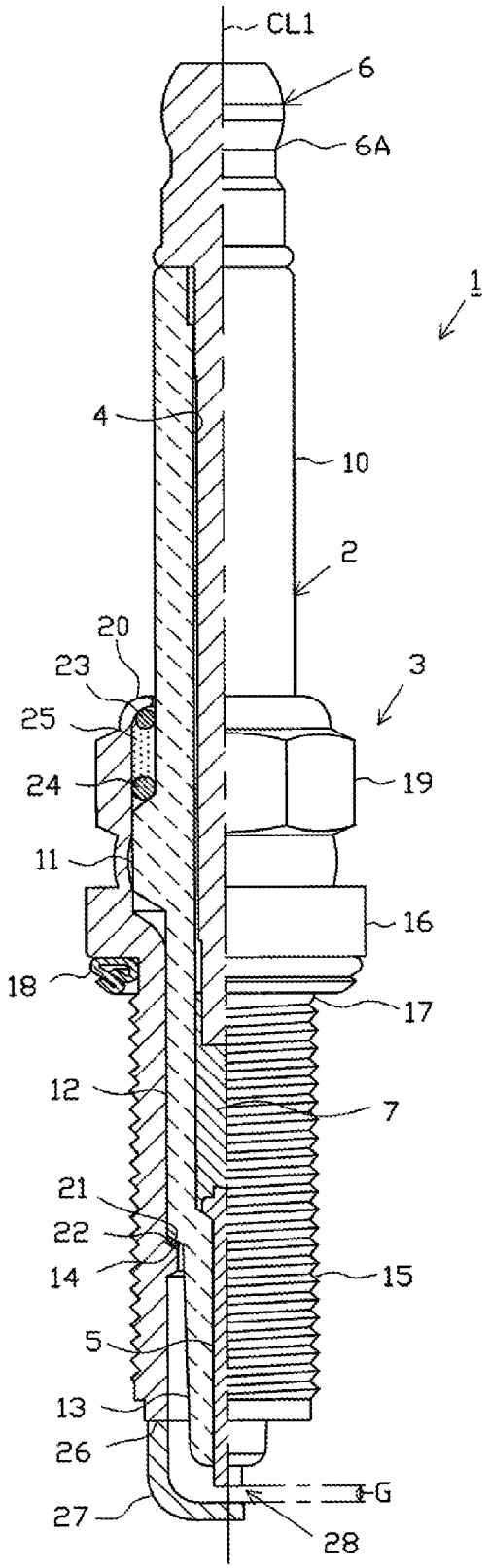
FIG. 2 is a partially cutaway front view depicting the configuration of a spark plug.

Firstly, the configuration of the spark plug 1 will be described. As depicted in FIG. 2, the spark plug 1 includes a cylindrical insulator 2 and a cylindrical metal shell 3 which supports the insulator 2. It should be noted that the description of the spark plug 1 will be made based on the understanding that in FIG. 2, the direction of an axis CIA of the spark plug 1 is referred to as a vertical direction, a lower end of the spark plug 1 is referred to as a front end thereof, and an upper end of the spark plug 1 is referred to as a rear end thereof.

As generally known, the insulator 2 is formed by baking alumina. The insulator 2 includes, as external portions, a rear body portion 10 which is formed at a rear end portion, a large diameter portion 11 which is formed in a position lying further forwards than the rear body portion 10 so as to protrude radially outwards, a middle body portion 12 which is formed in a position lying further forwards than the large diameter portion 11 so as to be smaller in diameter than the large diameter portion 11, and a nose portion 13 which is formed in a position lying further forwards than the middle body portion 12 so as to be smaller in diameter than the middle body portion 12. In addition, of the insulator 2, the large diameter portion 11, the middle body portion 12 and most of the nose portion 13 are housed in an interior of the metal shell 3. Additionally, a tapered step portion 14 is formed at a connecting portion between the middle body portion 12 and the nose portion 13, and the insulator 2 is locked on the metal shell 3 at this step portion 14.

Further, an axial hole 4 is formed in the insulator 2 so as to penetrate therethrough along the axis CL1, and a center electrode 5 is inserted in the axial hole 4 at a front end portion thereof. The center electrode 5 has a rod-like shape, and a front end thereof projects forwards from a front end of the insulator 2 in the direction of the axis CL1. Additionally, the center electrode 5 is made of an alloy whose main constituent is nickel (Ni). It should be noted that an inner layer made of a metal (for example, copper or a copper alloy, or pure Ni) which has superior heat conductivity may be provided in an interior of the center electrode 5. In this case, the heat dissipation of the center electrode 5 is increased, thereby making it possible to realize an improvement in durability.

Further, a rod-shaped terminal electrode 6 which is made of a metal such as a carbon steel is inserted in the axial hole 4 at a rear end portion thereof. In addition, a connecting portion 6A is provided at a rear end portion of the terminal electrode 6 so as to project from a rear end of the insulator 2. This connecting portion 6A is electrically connected with an output (a transmission line 32C, which will be described later) of the mixer circuit 61.

Furthermore, a cylindrical glass seal portion 7 is disposed between the center electrode 5 and the terminal electrode 6. The center electrode 5 and the terminal electrode 6 are electrically connected to each other by the glass seal portion 7. Additionally, the center electrode 5 and the terminal electrode 6 are fixed to the insulator 2 via the glass seal portion 7.

The metal shell 3 is made of a metal such as a low carbon steel and has a cylindrical shape. A thread portion (a male thread portion) 15 by which the spark plug 1 is mounted in a mounting hole in an internal combustion engine is formed on an outer circumferential surface thereof. Additionally, a collar-shaped seat portion 16 is formed at the outer circumferential surface of the rear end of the thread portion 15, and an annular gasket 18 is fitted on a thread neck 17 at a rear end of the thread portion 15. Further, a tool engagement portion 19 having a hexagonal cross section is provided at a rear end portion of the metal shell 3 for engagement with a tool such as a wrench in mounting the metal shell 3 in the internal combustion engine, and a crimped portion 20 by which the insulator 2 is held is provided at a rear end of the metal shell 3.

An annular step portion 21 is provided on an inner circumferential surface of the metal shell 3 so as to project radially inwards. The insulator 2 is inserted into the metal shell 3 from the rear end towards a front end thereof and is fixed to the metal shell 3 by crimping an opening portion at the rear end of the metal shell 3 radially inwards, that is, by forming the crimped portion 20 in such a state that the step portion 14 thereof is locked on the step portion 21 of the metal shell 3. Additionally, a circular ring-shaped plate packing 22 is interposed between the step portions 14, 21. By interposing the plate packing 22 in this way, the gas tightness within a combustion chamber is maintained so as to prevent the leakage of a fuel gas (an air-fuel mixture) which enters a gap between the nose portion 13 of the insulator 2 which is exposed to the interior of the combustion chamber and the inner circumferential surface of the metal shell 3 to the outside of the gap.

Further, in order to ensure the sealing by crimping more perfectly, circular ring members 23, 24 are interposed between the metal shell 3 and the insulator 2 at the rear end of the metal shell 3, and powder of talc 25 is filled between the ring members 23, 24. Namely, the metal shell 3 holds the insulator 2 via the plate packing 22, the ring members 23, 24 and the talc 25.

In addition, a rod-shaped ground electrode 27 is joined to a front end portion 26 of the metal shell 3. This ground electrode 27 is formed of an alloy whose main constituent is Ni and is bent radially inwards at a substantially middle portion. The ground electrode 27 faces a front end portion of the center electrode 5 at a side surface of a front end thereof, and a spark gap 28 is formed between the front end portion of the center electrode 5 and a front end portion of the ground electrode 27. In this embodiment, the size G of the spark gap 28 (a shortest distance between the center electrode 5 and the ground electrode 27) is set to be 0.3 mm or more and 1.3 mm or less.

Next, referring to FIG. 1, the configuration of the discharging power supply 41 will be described.

The discharging power supply 41 is such as to apply a high voltage to the spark plug 1 to thereby generate an electric spark discharge in the spark gap 28. In this embodiment, the discharging power supply 41 includes a primary coil 42, a secondary coil 43, a core 44 and an igniter 45.

The primary coil 42 is wound around the core 44. The primary coil 42 is connected to an electric power supply battery VA at one end and is connected to the igniter 45 at the other end thereof. Additionally, the secondary coil 43 is wound around the core 44. The secondary coil 43 is connected to a position lying between the primary coil 42 and the battery VA at one end and is connected to the terminal electrode 6 of the spark plug 1 via the mixer circuit 61 at the other end thereof.

Figure 3:
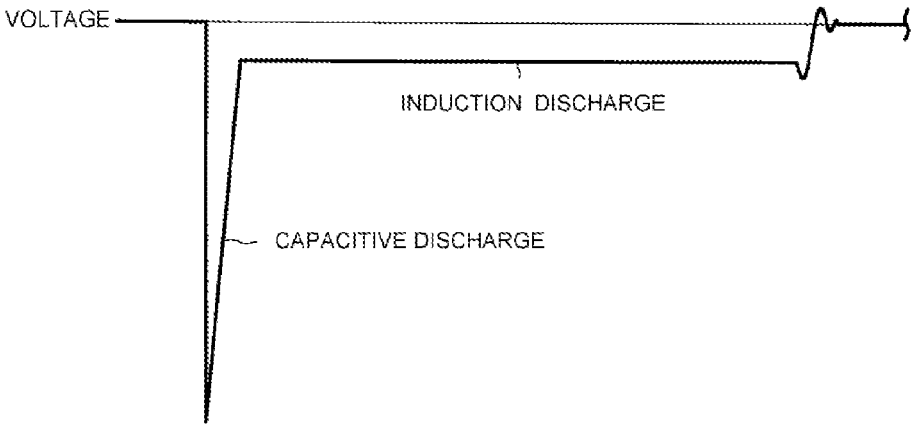
FIG. 3 is a wave form chart depicting a voltage applied from a discharging power supply to a spark gap.

In addition, the igniter 45 is formed of a predetermined transistor and switches between the start and stop of supply of electric power from the battery VA to the primary coil 42 in response to an energizing signal inputted from the controller 71. When a high voltage is applied to the spark plug 1, an electric current is fed from the battery VA to the primary coil 42 so as to form a magnetic field around the core 44 and then switches the energizing signal from the controller 71 from on to off to thereby stop the energization from the battery VA to the primary coil 42. As a result of stopping the energization, the magnetic field around the core 44 is changed, and a high voltage (for example, 5 kV to 30 kV) of a negative polarity is generated in the secondary coil 43. As a result of this high voltage being applied to the spark plug 1 (the spark gap 28), it is possible to generate an electric spark discharge in the spark gap 28. Additionally, as depicted in FIG. 3 (FIG. 3 is a wave form chart depicting a voltage applied to the spark gap 28 when only the voltage from the discharging power supply 41 is applied to the spark gap 28 without introducing any electric power from the alternating current power supply 51), an induction discharge in which a minute electric current continues to be fed is generated in the spark gap 28 after a capacitive discharge in which the voltage value changes largely by the voltage applied from the discharging power supply 41.

Returning to FIG. 1, the alternating current power supply 51 is such as to supply alternating current power of a relatively high frequency to the spark plug 1. Additionally, an impedance matching circuit (a matching module) 33 is provided between the alternating current power supply 51 and the mixer circuit 61. An output impedance on an alternating current power supply 51 side is made to coincide with an input impedance on a mixer circuit 61 or spark plug 1 (that is, a negative) side by the impedance matching circuit 33, whereby the attenuation of alternating current power that is supplied to the spark plug 1 side is prevented. Additionally, a transmission line of alternating current power from the alternating current power supply 51 to the spark plug 1 is made up of a coaxial cable having an inner conductor and an outer conductor which is disposed on an outer circumference of the inner conductor, as a result of which the reflection of electric power is prevented.

The mixer circuit 61 is such as to integrate a transmission line 32A carrying a high voltage outputted from the discharging power supply 41 and a transmission line 32B carrying alternating current power outputted from the alternating current power supply 51 into a single transmission line 32C which is connected to the spark plug 1. The mixer circuit 61 has a coil 62 and a capacitor 63. The coil 62 permits the passage of electric current of a relatively low frequency which is outputted from the discharging power supply 41 but prohibits the passage of electric current of a relatively high frequency which is outputted from the alternating current power supply 51, whereby the feeding of the electric current which is outputted from the alternating current power supply 51 to the discharging power supply 41 is suppressed. On the other hand, the capacitor 63 permits the passage of electric current of a relative high frequency which is outputted from the alternating current power supply 51 but prohibits the passage of electric current of a relative low frequency which is outputted from the discharging power supply 41, whereby the feeding of electric current which is outputted from the discharging power supply 41 to the alternating current power supply 51 is suppressed. The coil 62 may be omitted by using the secondary coil 43 in place of the coil 62.

Further, in this embodiment, an alternating current plasma can be generated in the spark gap 28 by supplying alternating current power from the alternating current power supply 51 to an electric spark generated in the spark gap 28 by the voltage from the discharging power supply 41. To describe this in greater detail, alternating current power is supplied from the alternating current power supply 51 while an induction discharge is being generated by the voltage from the discharging power supply 41. Then, a timing at which the voltage is applied to the spark plug 1 from the discharging power supply 41 and a timing at which alternating current power is supplied to the spark plug 1 from the alternating current power supply 51 are controlled by the controller 71 which is made up of a predetermined electronic control unit (ECU) 81.

Figure 4A:
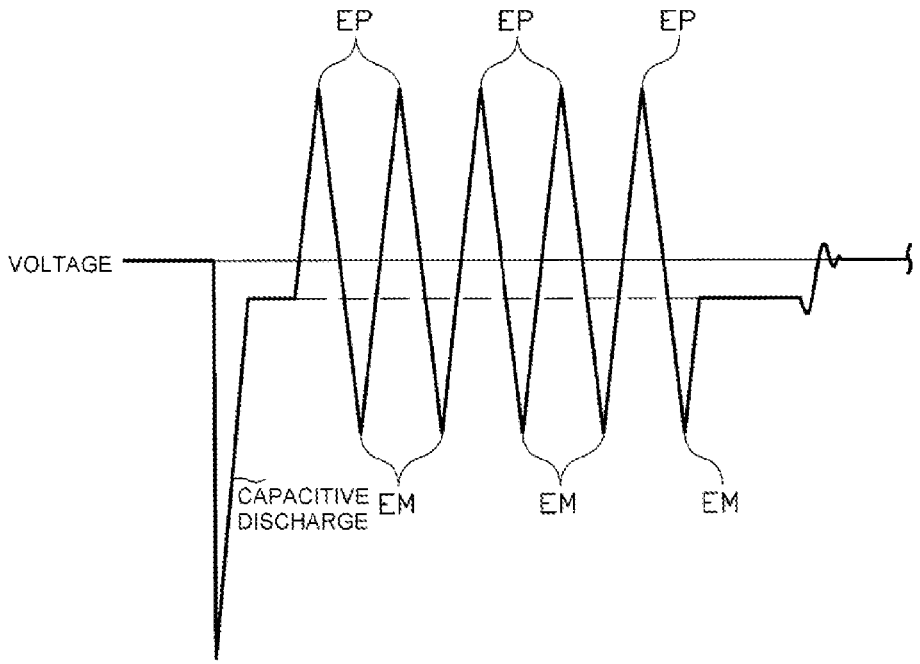
FIG. 4A is a wave form chart depicting a voltage application form to the spark gap.

In particular, in this embodiment, the voltage applied to the spark gap 28 from the alternating current power supply 51 is set as follows. Namely, as depicted in FIG. 4A, an output voltage from the alternating current power supply 51 is set so that a lower one of an absolute value of an average of peak values EP of a plus-side voltage which is applied to the spark gap 28 and an absolute value of an average of peak values EM of a minus-side voltage which is applied to the spark gap 28 in an introduction duration of alternating current is 20% or more (more preferably 70% or more) of a higher one of both the absolute values. Namely, a difference between the absolute value of the average of the peak values EP and the absolute value of the average of the peak values EM becomes sufficiently small. In this embodiment, the absolute value of the average of the peak values EP and the absolute value of the average of the peak values EM are made to become substantially equal to each other.

It should be noted that the "peak values EP" does not denote a voltage value at one apex where the voltage value becomes the largest but denotes individual voltage values at a plurality of plus-side apexes. Additionally, it should be noted that the "peak values EM" does not denote a voltage value at one apex where the voltage value becomes the minimum but denotes individual voltage values at a plurality of minus-side apexes.

Further, in this embodiment, the alternating current power supply 51 is configured so that the voltage of alternating current power which is introduced from the alternating current power supply 51 to the spark plug 1 is made to be larger than an absolute value of an average voltage of electric currents which are fed to the spark gap 28 during an induction discharge (that is, induction currents) by the voltage applied from the discharging power supply 41. It should be noted that the "voltage of alternating current power" means the capacity of the alternating current power supply 51 and denotes an average value of absolute values of peak values of the plus-side and minus-side voltages which are outputted from the alternating current power supply 51.

Figure 4B:
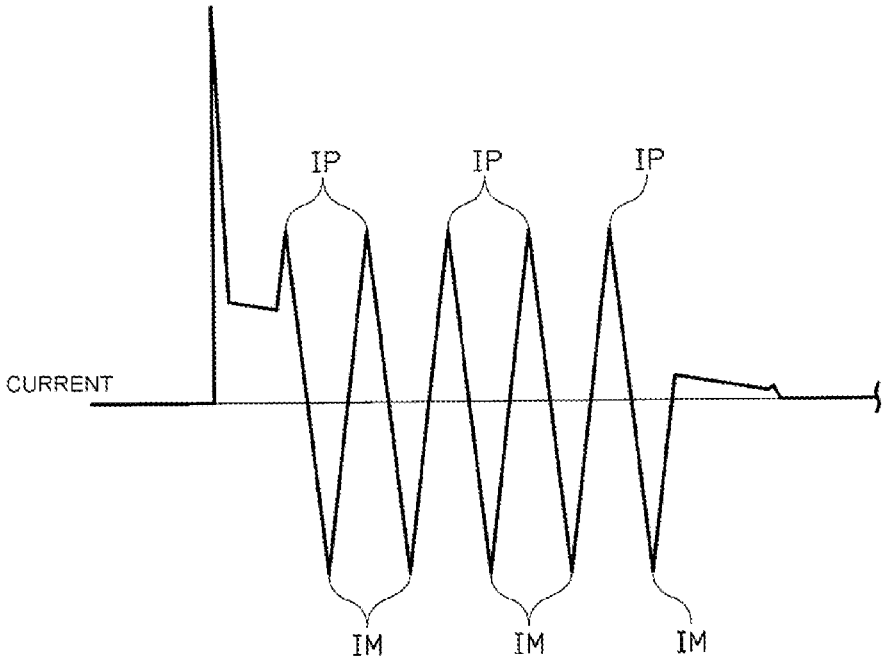
FIG. 4B is a wave form chart depicting a current introduction form to the spark gap.

In addition, in this embodiment, the electric current which is introduced from the alternating current power supply 51 to the spark gap 28 is set as follows. Namely, as depicted in FIG. 4B, a lower one of an absolute value of an average of peak values IP of a plus-side electric current which is fed to the spark gap 28 (an electric current fed from the center electrode 5 toward the ground electrode 27) and an absolute value of an average of peak values IM of a minus-side electric current which is fed to the spark gap 28 (an electric current fed from the ground electrode 27 towards the center electrode 5) in an introduction duration of alternating current power is 20% or more (more preferably, 70% or more) of a high one of both the absolute values. Namely, a difference between the absolute value of the average of the peak values IP and the absolute value of the average of the peak values IM is made to be sufficiently small. In this embodiment, the absolute value of the average of the peak values IP and the absolute value of the average of the peak values IM are made to become substantially equal to each other.

It should be noted that the "peak values IP" does not denote an electric current value at one apex where the electric current value becomes the largest but denotes individual electric current values at a plurality of plus-side apexes. Additionally, it should be noted that the "peak values IM" does not denote an electric current value at one apex where the electric current value becomes the minimum but denotes individual electric current values at a plurality of minus-side apexes.

Further, a higher one of an absolute value of an average of peak values IP of a plus-side electric current which is fed to the spark gap 28 and an absolute value of an average of peak values IM of a minus-side electric current which is fed to the spark gap 28 in an introduction duration of alternating current power (in this embodiment, both the absolute value of the average of the peak values IP and the absolute value of the average of the peak values IM) is set to be 1 A or more.

In addition, according to this embodiment, the oscillation frequency of alternating current power which is outputted from the alternating current power supply 51 is set to be 10 kHz or more.

Thus, as has been described in detail, according to the embodiment, since the voltages having different polarities are applied (the electric currents having different polarities are fed) to the spark gap 28, it is possible to generate the collision of atoms in the spark gap 28 with great frequency. Because of this, it is possible to increase plasmas (ions and electrons) which are generated in association with the collision of atoms.

Further, the lower one of the absolute value of the average of the peak values EP (the peak values IP) and the absolute value of the average of the peak values EM (the peak values IM) is 20% or more of the higher one of both the absolute values. Consequently, it is possible to generate the plasma of high density in a central portion of the spark gap 28. As a result of this, it is possible to allow the plasma to grow to be large, thereby making it possible to realize the superior ignitability assuredly.

In addition, the voltage of alternating current power which is introduced from the alternating current power supply 51 is made to be larger than the absolute value of the average voltage of induction currents fed to the spark gap 28 by the voltage applied from the discharging power supply 41. Consequently, both the plus-side voltage and the minus-side voltage can be applied to the spark gap 28 assuredly while the induction currents are being fed.

Additionally, in this embodiment, the higher one of the absolute value of the average of the peak values IP and the absolute value of the average of the peak values IM is set to be 1 A or more. Because of this, it is possible to increase the plasma generated in the spark gap 28, thereby making it possible to improve the ignitability further.

Alongside with this, since the oscillation frequency of alternating current power is set to be 10 kHz or more, it is possible to further increase the number of times of collision of atoms in the spark gap 28. As a result of this, it is possible to further increase the amount of plasma generated, thereby making it possible to much further improve the ignitability.

Further, according to this embodiment, since the plasma spreads largely towards the outside of the spark gap 28, even in the event that the size G of the spark gap 28 is very small, it is possible to realize the sufficiently superior ignitability. In addition, by decreasing the size of the spark gap 28, it is possible to realize a reduction in discharge voltage. As a result of this, not only can the erosion of the center electrode 5 and the ground electrode 27 be suppressed effectively, but also the electric spark discharge can be generated in the spark gap 28 assuredly.

In addition, since the size G of the spark gap 28 is set to be 0.3 mm or more, it is possible to increase the amount of plasma generated sufficiently, thereby making it possible to exhibit the improving effect of ignitability assuredly. On the other hand, since the size G of the spark gap 28 is set to be 1.3 mm or less, the generation of an excessive discharge voltage can be suppressed.

Next, with a view to verifying the working effects provided by the embodiment that has been described heretofore, a plurality of samples of ignition systems are prepared and theoretical plasma evaluation tests are carried out on the individual samples. In the samples so prepared, the difference between the average of the peak values of the plus-side voltage and the average of the peak values of the minus-side voltage is set to be different values of 800 V (800 Vp-p), 900 V (900 Vp-p) and 1000 V (1000 Vp-p). Additionally, a ratio of the lower one of the absolute value of the average of the peak values of the plus-side voltage and the absolute value of the average of the peak values of the minus-side voltage to the higher one of both the absolute values is changed variously.

The summary of the theoretical plasma evaluation tests is as follows. Namely, the samples are mounted in predetermined chambers. The pressure in the chambers is set to 0.1 MPa, and the atmosphere in interiors of the chambers is set to a standard gas atmosphere (an atmospheric atmosphere). Then, the air-fuel (AIF) ratio is set to 18, the output energy of the alternating current power supply is set to 500 mJ, and the oscillation frequency of alternating current power is set to 13 MHz. Then, Schlieren images are obtained at 1 ms after electric spark discharges. Then, the Schlieren images obtained are binarized by a predetermined threshold, and areas of portions of high density (that is, portions where plasma is generated) are measured as flame areas. A large flame area means that plasma grows to be large, and it is said that a large flame area provides superior ignitability.

Figure 5:
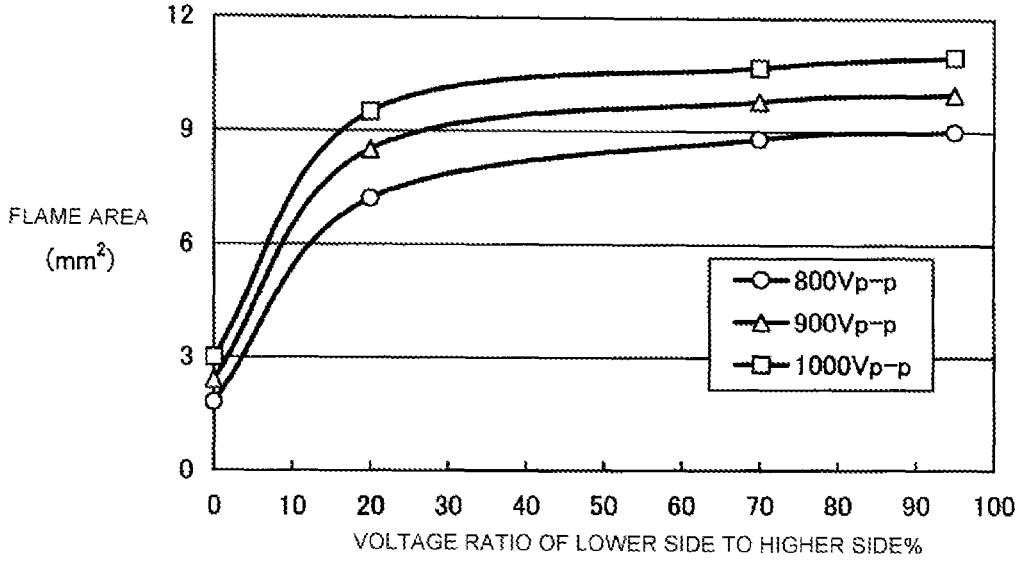
FIG. 5 is a graph depicting the results of theoretical plasma evaluation tests on a case where a ratio of a lower one of an absolute value of an average of peak values of a plus-side voltage and an absolute value of an average of peak values of a minus-side voltage to a higher one of both the absolute values is changed.

FIG. 5 depicts the results of the theoretical plasma evaluation tests so carried out. It should be noted that in FIG. 5, the result of the theoretical plasma evaluation test carried out on the sample in which the difference between the average of the peak values of the plus-side voltage and the average of the peak values of the minus-side voltage is set to 800 V (800 Vp-p) is indicated by circular marks, the result of the theoretical plasma evaluation test carried out on the sample in which the difference is set to 900 V (900 Vp-p) is indicated by triangular marks, and the result of the theoretical plasma evaluation test carried out on the sample in which the difference is set to 1000 V (1000 Vp-p) is indicated by square marks. In addition, in the respective samples, the size of spark gaps is set to 1.1 mm. Further, the absolute value of an average voltage of an induction current which is generated by the voltage applied from the discharging power supply is made to be about 500 V.

As depicted in FIG. 5, it is found out that with the sample in which the lower one of the absolute value of the average of the peak values of the plus-side voltage and the absolute value of the average of the peak values of the minus-side voltage is set to 20% or more of the higher one of both the absolute vales, the flame area is increased remarkably, providing the superior ignitability. It is considered that the preferred feature of the sample above resulted from the synergetic action of the following two facts (1), (2).

(1) The fact that as a result of applying the voltages of different polarities to the spark gap, the collision of atoms is generated in the spark gap with great frequency, whereby the plasma generated is increased.

(2) The fact that as a result of the difference between the absolute value of the plus-side voltage and the absolute value of the minus-side voltage being made small, the plasma of high density is generated in the central portion of the spark gap around which there are few things that suppress the propagation of plasma such as the center electrode and the ground electrode, which is spaced apart from both the center electrode and the ground electrode and which is affected less by the flame extinguishing action by the electrodes, allowing the plasma to grow to be large.

In addition, in particular, it is confirmed that with the sample in which the lower one of the absolute value of the average of the peak values of the plus-side voltage and the absolute value of the average of the peak values of the minus-side voltage is set to be 70% or more of the higher one of both the absolute vales, the flame area is increased further, providing the ignitability which is more superior.

It is said from the results of the theoretical plasma evaluation tests carried out that it is preferable in realizing superior ignitability to set the lower one of the absolute value of the average of the peak values of the plus-side voltage which is applied to the spark gap and the absolute value of the average of the peak values of the minus-side voltage which is applied to the spark gap during the introduction duration of alternating current power to be 20% or more of the higher one of both the absolute values.

It is said that it is preferable in realizing a further improvement in ignitability to set the lower one of the absolute value of the average of the peak values of the plus-side voltage which is applied to the spark gap and the absolute value of the average of the peak values of the minus-side voltage which is applied to the spark gap during the introduction duration of alternating current power to be 70% or more of the higher one of both the absolute values.

Figure 6:
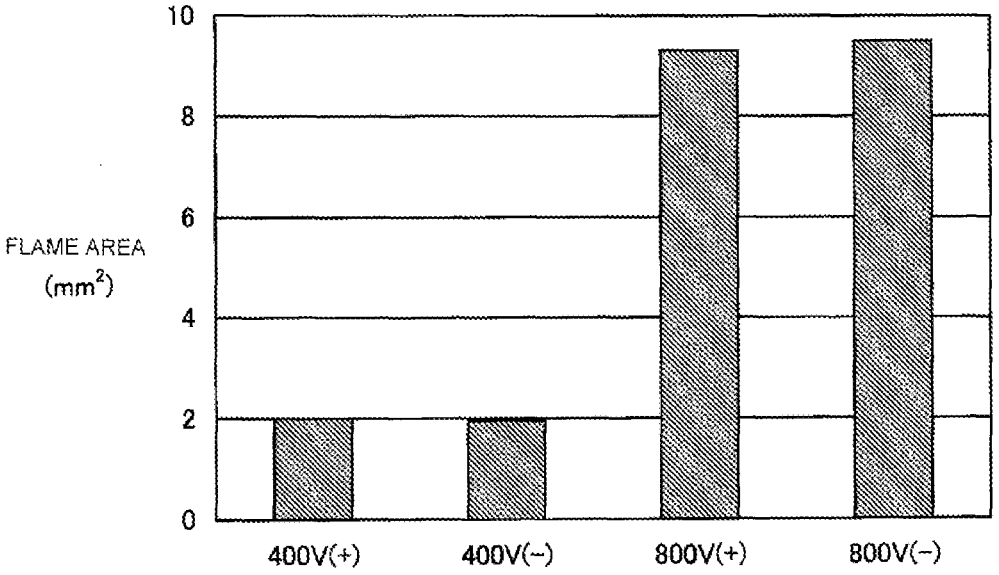
FIG. 6 is a graph depicting the results of theoretical plasma evaluation tests on a case where the capacity of an alternating current power supply is changed variously.

Next, samples of ignition systems are prepared and theoretical plasma evaluation tests are carried out on the individual samples. In the samples so prepared, the power supply capacity (the voltage of alternating current power that is introduced from the alternating current power supply into the spark gap) is set to different values of 400 V (−), 400 V (+), 800 V (−) and 800 V (+). FIG. 6 depicts the results of the theoretical plasma evaluation tests carried out.

It should be noted that in the individual samples, the size of the spark gap is 1.1 mm. Additionally, the absolute value of an average voltage of an induction current which is generated by the voltage applied from the discharging power supply is made to be about 500 V.

As depicted in FIG. 6, it is found out that with the sample in which the voltage of the alternating current voltage introduced from the alternating current power source is set to be larger than the absolute value of the average voltage of the induction currents generated by the voltage applied from the discharging power supply, the flame area is increased remarkably, providing the superior ignitability. It is considered that this preferred feature resulted from the more ensured alternate application of the plus-side voltage and the minus-side voltage to the spark gap during the feeding of the induction currents to the spark gap.

According to the results of the theoretical plasma evaluation tests, it is preferable that the voltage of alternating current power introduced from the alternating current power supply be larger than the absolute value of the average voltages of induction currents fed to the spark gap by the voltage applied from the discharging power supply in order to assuredly enhance the effect of improved ignitability.

Following this, a plurality of samples of ignition systems are prepared and theoretical plasma evaluation tests are carried out on the individual samples. In the samples so prepared, a higher one of an absolute value of an average of peak values of a plus-side current and an absolute value of an average of peak values of a minus-side current in the alternating current power supply is set to different values of 6 A, 7 A and 8 A. Then, a ratio of the lower one of the absolute value of the average of the peak values of the plus-side current and the absolute value of the average of the peak values of the minus-side current to the higher one of both the absolute values is changed variously.

Figure 7:
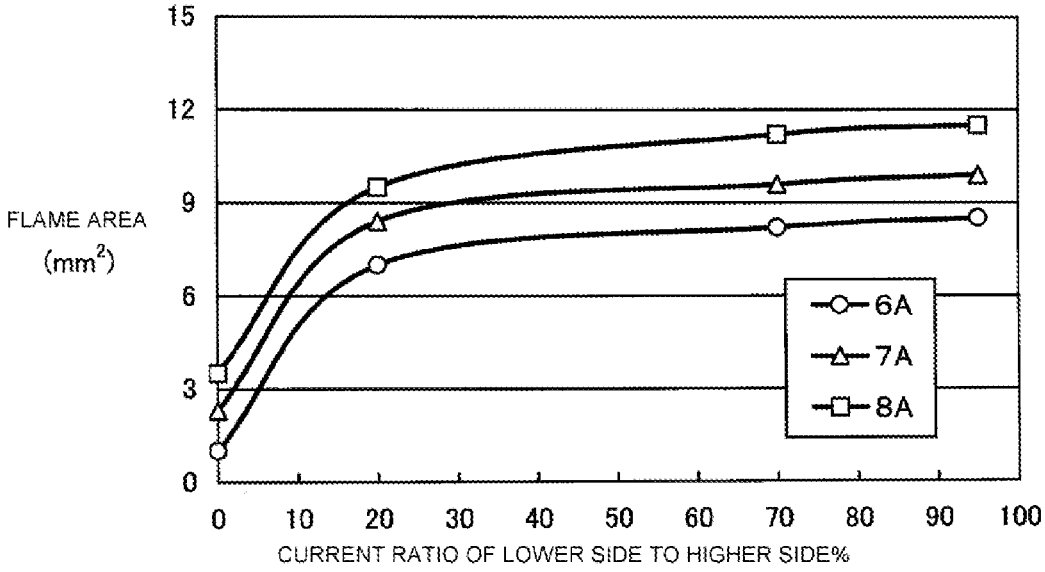
FIG. 7 is a graph depicting the results of theoretical plasma evaluation tests on a case where a ratio of a lower one of an absolute value of an average of peak values of a plus-side current and an absolute value of an average of peak values of a minus-side current to a higher one of both the absolute values is changed.

FIG. 7 depicts the results of the theoretical plasma evaluation tests carried out. In FIG. 7, the result of the theoretical plasma evaluation test carried out on the sample in which the higher one of the absolute value of the average of the peak values of the plus-side current and the absolute value of the average of the peak values of the minus-side current is set to 6 A is indicated by circular marks, the results of the test carried out on the sample in which the higher one of the absolute values is set to 7 A is indicated by triangular marks, and the result of the test carried out on the sample in which the higher one of the absolute values is set to 8 A is indicated by square marks. In addition, in the respective samples, the difference between the average of the peak values of the plus-side voltage and the average of the peak values of the minus-side voltage is set to 900 V (900 Vp-p) and the size of the spark gap is 1.1 mm.

As depicted in FIG. 7, it is made clear that with the sample in which the lower one of the absolute value of the average of the peak values of the plus-side current and the absolute vale of the average of the peak values of the minus-side current is set to be 20% or more of the higher one of both the absolute values, the flame area is increased remarkably, providing the superior ignitability.

In addition, in particular, it is confirmed that with the sample in which the lower one of the absolute value of the average of the peak values of the plus-side current and the absolute value of the average of the peak values of the minus-side current is set to be 70% or more of the higher one of both the absolute vales, the ignitability is provided which is more superior.

It is said from the results of the theoretical plasma evaluation tests carried out that it is preferable in realizing superior ignitability to set the lower one of the absolute value of the average of the peak values of the plus-side current which is fed to the spark gap and the absolute value of the average of the peak values of the minus-side current which is fed to the spark gap during the introduction duration of alternating current power to be 20% or more of the higher one of both the absolute values.

Further, from the viewpoint of improving the ignitability further, it is said that it is preferable to set the lower one of the absolute value of the average of the peak values of the plus-side current which is fed to the spark gap and the absolute value of the average of the peak values of the minus-side current which is fed to the spark gap during the introduction duration of alternating current power to be 70% or more of the higher one of both the absolute values.

Next, a plurality of samples of ignition systems are prepared, and theoretical plasma evaluation tests are carried out on the individual samples. In the samples prepared, alternating current power supplies are used in which the higher one of the absolute value of the average of the peak values of the plus-side current and the absolute value of the average of the peak values of the minus-side current is set variously to different values.

Figure 8:
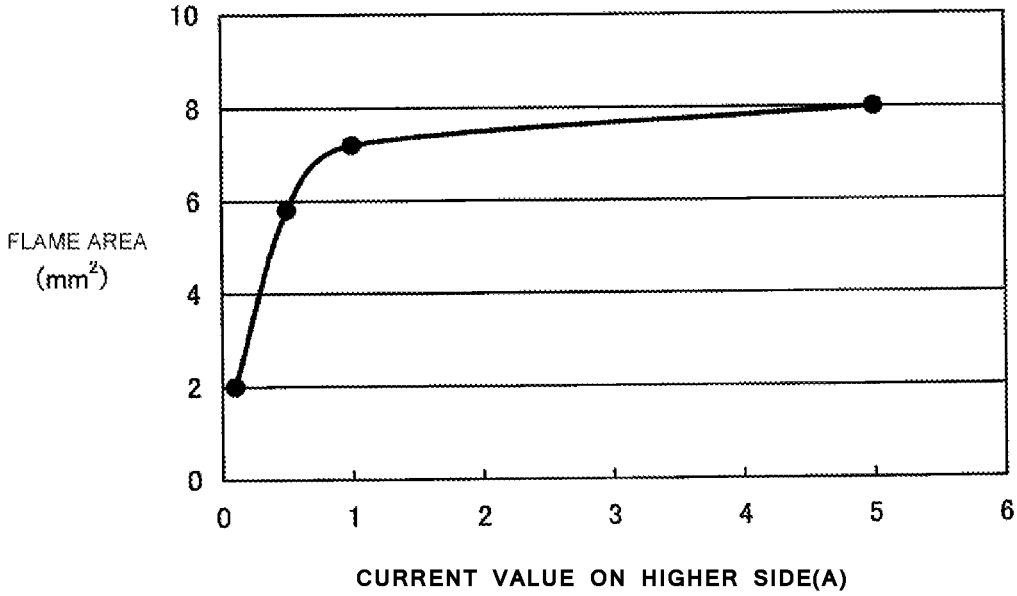
FIG. 8 is a graph depicting the results of theoretical plasma evaluation tests on a case where a higher one of an absolute value of an average of peak values of a plus-side current and an absolute value of an average of peak values of a minus-side current is changed.

FIG. 8 depicts the results of the theoretical plasma evaluation tests carried out. In the samples, a difference between the average of the peak values of the plus-side voltage and the average of the peak values of the minus-side voltage is set to 900 V (900 Vp-p), and the size of the spark gap is 1.1 mm.

As depicted in FIG. 8, it is found out that with the sample in which the higher one of the absolute value of the average of the peak values of the minus-side current and the absolute value of the average of the peak values of the plus-side current is set to be 1 A or more, the flame area is increased remarkably and that the ignitability is improved more effectively. It is considered that this preferred feature resulted from the fact that the generation of plasma is increased in association with the increase in current, allowing the plasma to grow to be larger.

It is said from the results of the theoretical plasma evaluation tests that with a view to improving the ignitability assuredly, the higher one of the absolute value of the average of the peak values of the plus-side current which is fed to the spark gap and the absolute value of the average of the peak values of the minus-side current which is fed to the spark gap is set to be 1 A or more.

Figure 9:
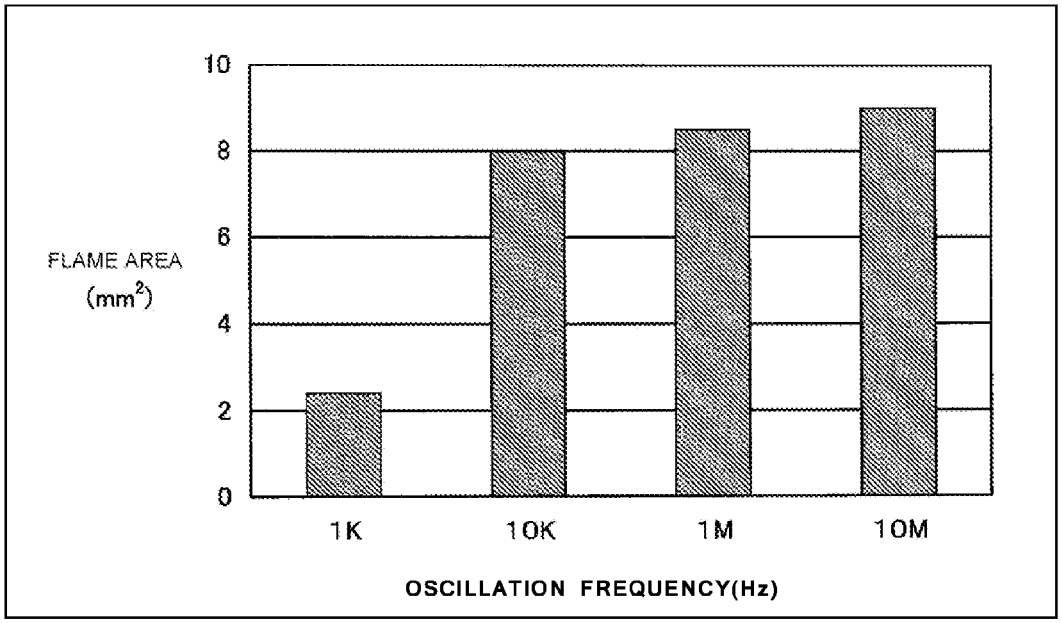
FIG. 9 is a graph depicting the results of theoretical plasma evaluation tests on a case where the oscillation frequency of alternating current power is changed.

Following this, samples of ignition systems are prepared, and theoretical plasma evaluation tests are carried out on the individual samples prepared. In the samples prepared, the oscillation frequency of alternating current power of the alternating current power supply is changed variously. FIG. 9 depicts the results of the theoretical plasma evaluation tests carried out. It should be noted that in the theoretical plasma evaluation tests carried out, a difference between an average of peak values of a plus-side voltage and an average of peak values of a minus-side voltage is set to be 900 V (900 Vp-p), a higher one of an absolute value of an average of peak values of a plus-side current and an absolute value of an average of peak values of a minus-side current is set to be 6 A, and the size of a spark gap is set to be 1.1 mm.

As depicted in FIG. 9, it is made clear that as a result of the oscillation frequency of alternating current power being set to be 10 kHz or more, the flame area is increased remarkably, providing the ignitability which is extremely superior. It is considered that this preferred feature resulted from the fact that the frequency with which the collision of atoms occurred in the spark gap is increased remarkably, resulting in a further increase in plasma generated.

It is said from the results of the theoretical plasma evaluation tests carried out that it is preferable in improving the ignitability further to set the oscillation frequency of alternating current power to be 10 kHz or more.

Figure 10:
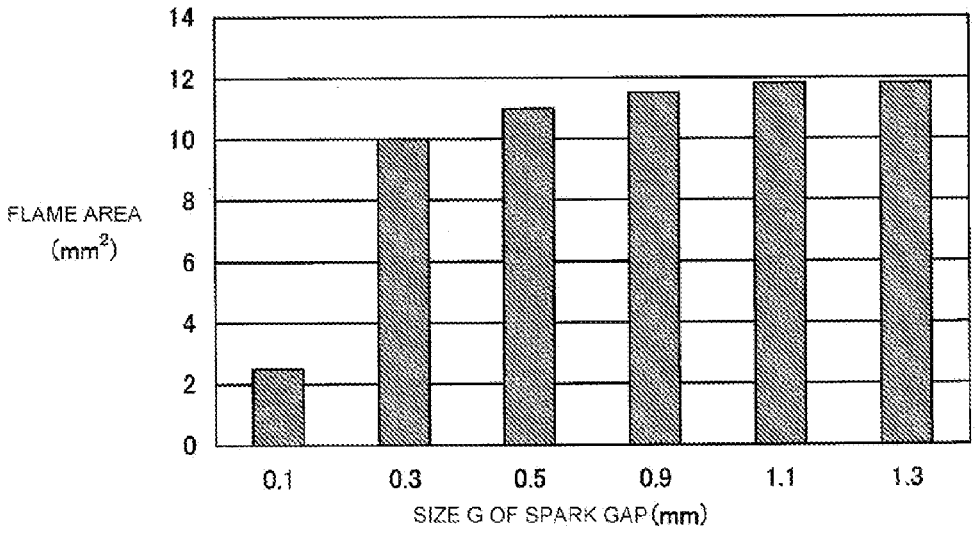
FIG. 10 is a graph depicting the results of theoretical plasma evaluation tests on a case where the size of a spark gap is changed.

Next, samples of ignition systems are prepared, and theoretical plasma evaluation tests are carried out on the individual samples prepared. In the samples prepared, the size G of the spark gap is changed variously. FIG. 10 depicts the results of the theoretical plasma evaluation tests carried out. It should be noted that in the theoretical plasma evaluation tests carried out, a difference between an average of peak values of a plus-side voltage and an average of peak values of a minus-side voltage is set to be 900 V (900 Vp-p), and a higher one of an absolute value of an average of peak values of a plus-side current and an absolute value of an average of peak values of a minus-side current is set to be 8 A.

As depicted in FIG. 10, it is made clear that as a result of the size G of the spark gap being set to 0.3 mm or more, the plasma is allowed to grow to be larger. It is considered that this preferred feature is obtained by the facts that the interruption of propagation of plasma by the electrodes existing is suppressed and that the influence of flame extinguishing action by the electrodes is reduced sufficiently small.

It is said from the results of the theoretical plasma evaluation tests carried out that it is preferable to set the size G of the spark gap to 0.3 mm or more so as to further improve the ignitability.

It should be noted that in the event that the size G of the spark gap is more than 1.3 mm, there are fears that the discharge voltage becomes so large as to promote the deterioration of erosion resistance of the center electrode and the ground electrode and that electric spark discharges occur in other locations than the spark gap. In view of these drawbacks, it is said that it is preferable to set the size G of the spark gap to 1.3 mm or less.

The invention is not limited to the details of the embodiment that has been described heretofore, and hence, the invention may be carried out as follows. Application examples and modified examples other than those which will be illustrated below can, of course, be carried out.

Figure 11:
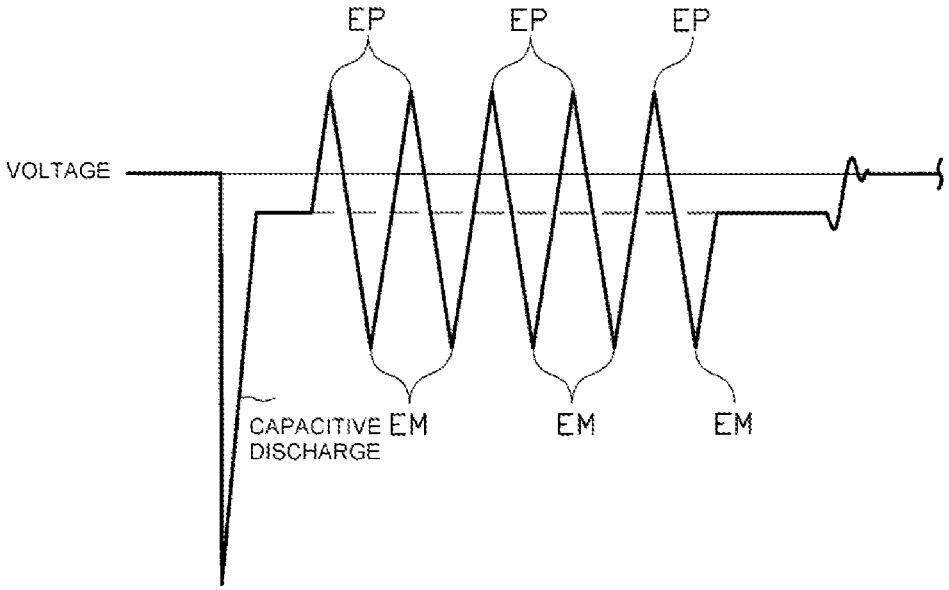
FIG. 11 is a wave form chart depicting a form of voltage application to a spark gap in another embodiment.

(a) In the embodiment, while the absolute value of the average of the peak values EP and the absolute value of the average of the peak values EM are made to be substantially equal to each other, the relation in magnitude between both the absolute values is not limited thereto, provided that the lower one of the absolute value of the average of the peak values EP and the absolute value of the average of the peak values EM during the introduction duration of alternating current power is 20% or more of the higher one of both the absolute values. Consequently, for example, as depicted in FIG. 11, an absolute value of an average of peak values EP may be made to be smaller than an absolute value of an average of peak values EM. Alternatively, the absolute value of the average of the peak values EP may be made to be larger than the absolute value of the average of the peak values EM.

Figure 12:
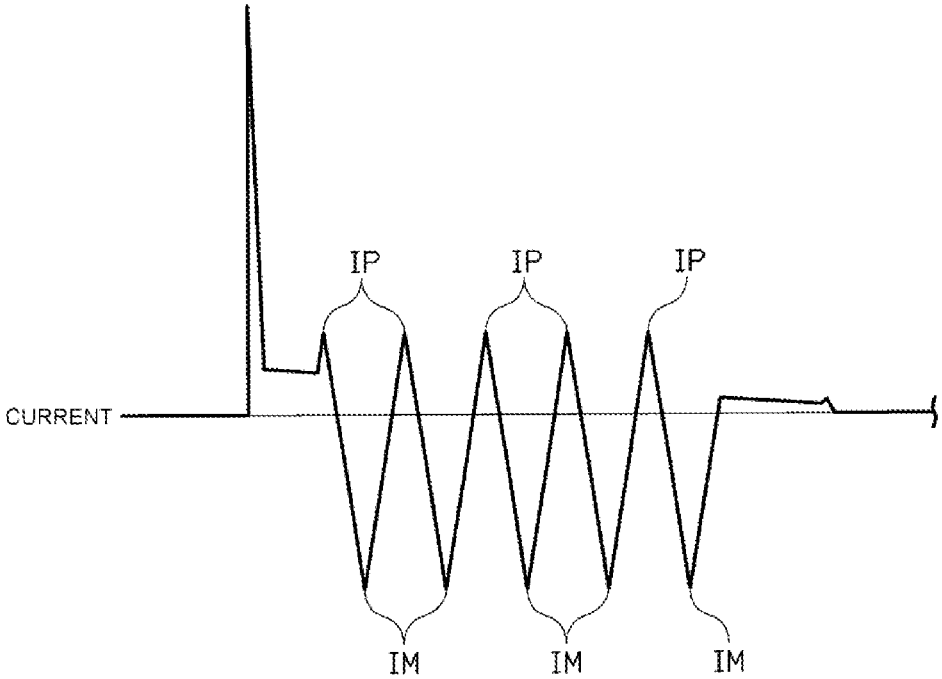
FIG. 12 is a wave form chart depicting a form of current introduction to a spark gap in a further embodiment.

(b) In the embodiment, while the absolute value of the average of the peak values IP and the absolute value of the average of the peak values IM are made to be substantially equal to each other, the relation in magnitude between both the absolute values is not limited thereto, provided that the lower one of the absolute value of the average of the peak values IP and the absolute value of the average of the peak values IM during the introduction duration of alternating current power is 20% or more of the higher one of both the absolute values. Consequently, for example, as depicted in FIG. 12, an absolute value of an average of peak values IP may be made to be smaller than an absolute value of an average of peak values IM. Alternatively, the absolute value of the average of the peak values TP may be made to be larger than the absolute value of the average of the peak values IM.

Figure 13:
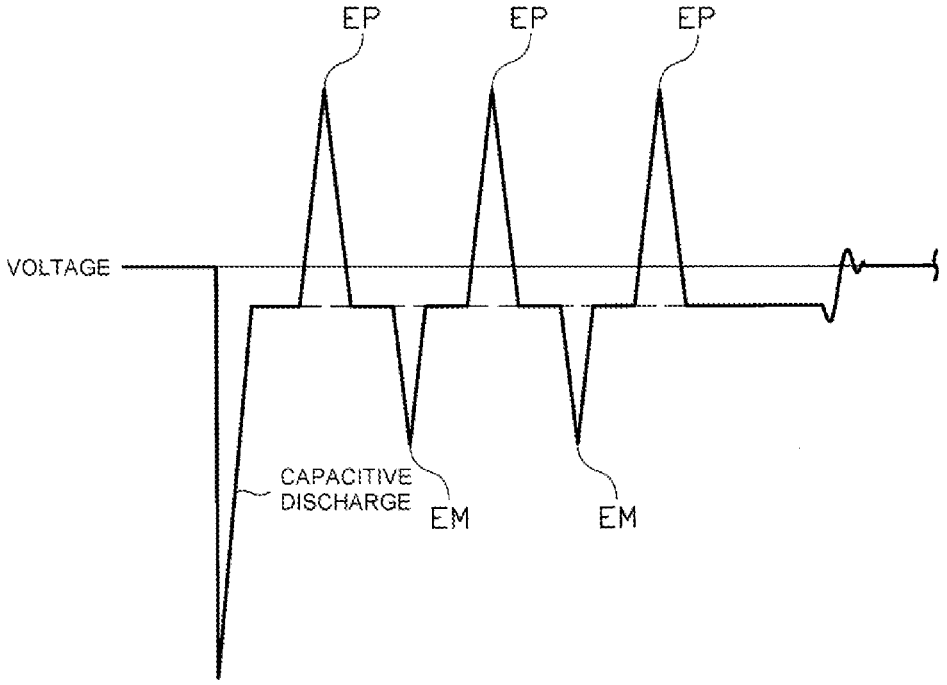
FIG. 13 is a wave form chart depicting a form of voltage application to a spark gap in an embodiment.
Figure 14:
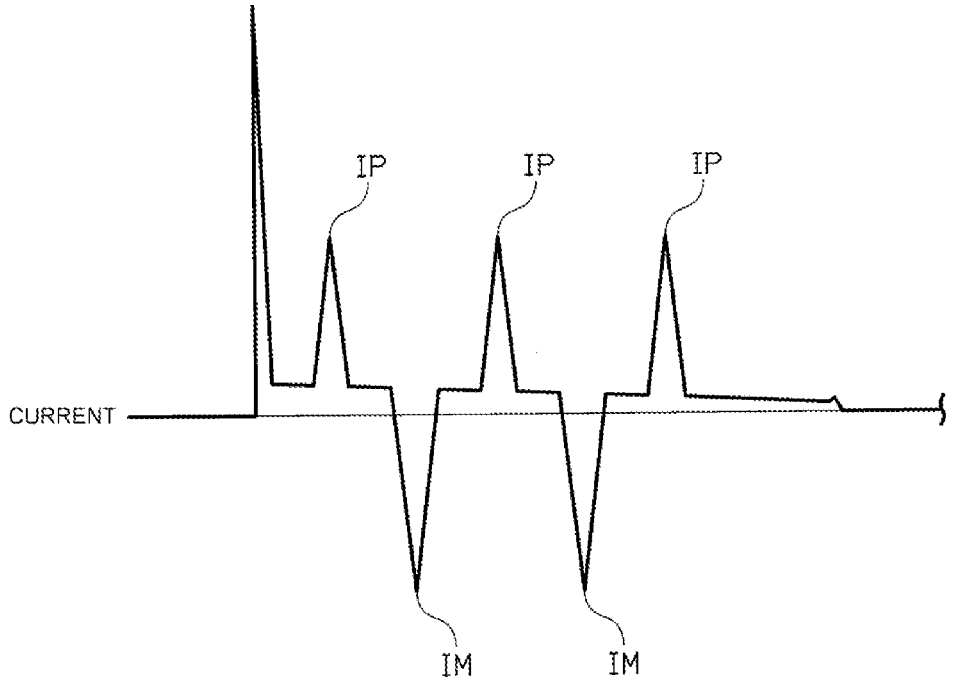
FIG. 14 is a wave form chart depicting a form of current introduction to a spark gap in another embodiment.

(c) In the embodiment, while the plus-side voltage and the minus-side voltage are configured to be applied continuously (the plus-side current and the minus-side current are configured to be fed continuously) from the alternating current power supply 51 to the spark gap 28, the form of application of the voltages (the form of feeding the currents) to the spark gap 28 is not limited thereto. Consequently, for example, as depicted in FIGS. 13, 14, configurations may be adopted in which a plus-side voltage and a minus-side voltage are applied intermittently (a plus-side current and a minus-side current are fed intermittently) from the alternating current power supply 51 to the spark gap 28.

(d) In the embodiment, while electric power from the discharging power supply 41 and the alternating current power supply 51 is supplied to the individual spark plugs 1 via the distributer, a configuration may be adopted in which a discharging power supply 41 and an alternating current power supply 51 are provided for each of the spark plugs 1.

(e) In the embodiment, while the controller 71 is made up of the ECU 81, the controller 71 may not be made up of the ECU 81 but may be made up of a microcomputer, for example. Additionally, a configuration may be adopted in which the discharging power supply 41 is controlled by the ECU, while the alternating current power supply 51 is controlled by the controller which is made up of the microcomputer.

(f) The configuration of the spark plug 1 described in the embodiment is only one example, and the configuration of a spark plug to which the technical concept of the invention can be applied is not limited thereto.

Having described the invention, the following is claimed:

1. An ignition system comprising:

a spark plug having a center electrode and a ground electrode;

a discharging power supply which applies a voltage to a spark gap defined between the center electrode and the ground electrode to generate an electric spark discharge in the spark gap;

an alternating current power supply which introduces alternating current power to an electric spark generated by the electric spark discharge so as to generate an alternating current plasma in the spark gap; and a controller for controlling a timing at which the alternating current power of the alternating current power supply is supplied to the spark plug, an output voltage of the alternating current power set so that, in an introduction duration of the alternating current power, a lower one of (i) a first absolute value of an average of peak values of a plus-side voltage applied to the spark gap and (ii) a second absolute value of an average of peak values of a minus-side voltage applied to the spark gap, is 20% or more of a higher one of the first and second absolute values.

2. The ignition system according to claim 1, wherein, in the introduction duration of the alternating current power, the lower one of (i) the first absolute value of the average of peak values of a plus-side voltage applied to the spark gap and (ii) the second absolute value of the average of peak values of the minus-side voltage applied to the spark gap, is 70% or more of a higher one of the first and second absolute values.

3. The ignition system according to claim 1, wherein a voltage of alternating current power which is introduced from the alternating current power supply is larger than an absolute value of an average voltage of an induction current which is fed to the spark gap by a voltage applied from the discharging power supply.

4. An ignition system comprising:

a spark plug having a center electrode and a ground electrode;

a discharging power supply which applies a voltage to a spark gap defined between the center electrode and the ground electrode to generate an electric spark discharge in the spark gap;

an alternating current power supply which introduces alternating current power to an electric spark generated by the electric spark discharge so as to generate an alternating current plasma in the spark gap; and a controller for controlling a timing at which the alternating current power of the alternating current power supply is supplied to the spark plug, an output voltage of the alternating current power set so that, in an introduction duration of the alternating current power, a lower one of (i) a first absolute value of an average of peak values of a plus-side current fed to the spark gap and (ii) a second absolute value of an average of peak values of a minus-side current fed to the spark gap, is 20% or more of a higher one of the first and second absolute values.

5. The ignition system according to claim 4, wherein, in the introduction duration of the alternating current power, the lower one of (i) the first absolute value of the average of peak values of a plus-side current fed to the spark gap and (ii) the second absolute value of the average of peak values of the minus-side current fed to the spark gap, is 70% or more of a higher one of the first and second absolute values.

6. The ignition system according to claim 4, wherein, in the introduction duration of the alternating current power, a higher one of (i) a first absolute value of an average of peak values of a plus-side current fed to the spark gap and (ii) a second absolute value of an average of peak values of a minus-side current fed to the spark gap, is 1 A or more.

7. The ignition system according to claim 1, wherein an oscillation frequency of the alternating current power is 10 kHz or more.

8. The ignition system according to claim 1, wherein 0.3 mm≤G≤1.3, where G is the size of the spark gap.

9. The ignition system according to claim 4, wherein an oscillation frequency of the alternating current power is 10 kHz or more.

10. The ignition system according to claim 4, wherein 0.3 mm≤G≤1.3, where G is the size of the spark gap.

* * * * *